US006658768B1

(12) United States Patent
Bainter

(10) Patent No.: US 6,658,768 B1
(45) Date of Patent: Dec. 9, 2003

(54) TRENCHER

(76) Inventor: Wesley Allen Bainter, P.O. Box 705, Hoxie, KS (US) 67740

( * ) Notice: Subject to any disclaimer, the term of this patent is extended or adjusted under 35 U.S.C. 154(b) by 0 days.

(21) Appl. No.: 10/147,834

(22) Filed: May 17, 2002

Related U.S. Application Data

(60) Provisional application No. 60/292,216, filed on May 19, 2001, and provisional application No. 60/346,040, filed on Jan. 4, 2002.

(51) Int. Cl.[7] ..... E02F 3/08

(52) U.S. Cl. ..... 37/352; 37/357; 37/360; 37/464

(58) Field of Search ..... 37/352, 353, 357, 37/359, 360, 356, 363, 364, 464; 180/235, 418

(56) References Cited

U.S. PATENT DOCUMENTS

| | | | | | |
|---|---|---|---|---|---|
| 1,769,074 | A | * | 7/1930 | Ruatti | 180/9.3 |
| 2,748,504 | A | * | 6/1956 | Mcininch | 37/352 |
| 2,751,698 | A | * | 6/1956 | Brown | 37/352 |
| 2,783,556 | A | * | 3/1957 | Burns et al. | 37/361 |
| 2,828,557 | A | * | 4/1958 | Brown | 37/363 |
| 2,846,786 | A | * | 8/1958 | Barber et al. | 37/352 |
| 3,380,547 | A | * | 4/1968 | Granryd | 180/419 |
| 3,388,487 | A | * | 6/1968 | Schmidt | 37/352 |
| 3,603,010 | A | * | 9/1971 | Polinek | 37/353 |
| 3,605,903 | A | * | 9/1971 | Glesmann | 172/3 |
| 3,605,908 | A | * | 9/1971 | McDonald et al. | 172/438 |
| 3,659,364 | A | * | 5/1972 | Wilson | 37/348 |
| 3,771,241 | A | * | 11/1973 | Lindell et al. | 37/352 |
| 4,103,441 | A | | 8/1978 | Flippin | |
| 4,195,427 | A | | 4/1980 | Lanham | |
| 4,277,898 | A | * | 7/1981 | Flippin | 37/348 |
| 4,322,899 | A | * | 4/1982 | Clune | 37/352 |
| 4,483,084 | A | * | 11/1984 | Caldwell et al. | 37/349 |
| 4,716,665 | A | | 1/1988 | Johnson et al. | |
| 4,732,507 | A | * | 3/1988 | Artzberger | 404/117 |
| 4,750,280 | A | * | 6/1988 | Dalaine | 37/352 |
| 4,833,797 | A | * | 5/1989 | Slunecka et al. | 37/352 |
| 4,974,348 | A | * | 12/1990 | Wallace | 37/465 |
| 5,033,214 | A | * | 7/1991 | Kaczmarski et al. | 37/350 |
| 5,228,221 | A | | 7/1993 | Hillard et al. | |
| 5,964,049 | A | | 10/1999 | Dean et al. | |
| 6,249,993 | B1 | * | 6/2001 | Armstrong et al. | 37/361 |
| 6,266,900 | B1 | * | 7/2001 | Bizzell | 37/358 |
| 6,516,545 | B2 | * | 2/2003 | Jenkins, Jr. | 37/362 |
| 2002/0116844 | A1 | * | 8/2002 | Collins et al. | 37/364 |

* cited by examiner

*Primary Examiner*—Thomas B. Will
*Assistant Examiner*—Thomas A. Beach
(74) *Attorney, Agent, or Firm*—Chase Law Firm, L.C.; Robert Blinn

(57) ABSTRACT

The trencher includes a wheeled carriage which has a steering mechanism and a digging which operates along an upright path. The trencher includes an upright boom structure that is mounted to the carrage and a digging chain support frame that can be raised and lowered relative to the trencher carriage along an upright path. The digging chain is mounted to the digging chain support frame by a powered sprocket wheel and a freely turning pulley wheel. The sprocket wheel the pulley wheel are positioned so that the digging chain describes an upright path. The path described by the digging chain is sufficiently upright so that the trencher can excavate a curved trench without the digging chain interfering with the walls of the trench to a degree that is sufficient to impede the operation of the trencher.

11 Claims, 5 Drawing Sheets

TRENCHER

CROSS REFERENCES TO RELATED APPLICATIONS

This application claims the benefit of U.S. Provisional Patent Application No. 60/292,216 filed May 19, 2001 and U.S. Provisional Patent Application No. 60/346,040 filed Jan. 4, 2002.

FIELD OF THE INVENTION

The present invention relates to a trencher that can dig a curved trench.

BACKGROUND OF THE INVENTION

Trenchers that use digging chains have long been known in the prior art. Generally, a trencher includes a carriage and a trencher boom that carries a digging chain having a series of digging blades. Typically, the digging chain is carried by a motor driven sprocket wheel and an idler pulley wheel which are mounted to a frame that can be moved into a digging position. Generally, the frame that carries the digging chain pivots at its base to tilt into contact with a working surface of soil or clay so that the digging chain can excavate a trench as the trencher moves across the working surface.

U.S. Pat. No. 4,483,084 by Caldwell et al. is exemplary of the prior art. Caldwell's trencher includes a boom that pivots relative to a carriage so that it can dig at various angles and depths. If a shallow trench is desired, an operator of Caldwell's trencher would pivot the trencher boom by a shallow angle. If a deep trench is desired, an operator would pivot the trencher boom of the Caldwell trencher until it reaches a steep angle.

The disadvantages of prior art trenchers arise when an operator wishes to dig a curved trench. For example, relatively shallow, circular trenches are needed for receiving the concrete footing of the foundation of a circular structure such as a grain bin or a tank. Trenches of greater depth that are excavated for water or electric power lines must often be dug around obstacles. Because the digging chains of prior art trenchers must generally pivot into a digging position, the digging chain of a prior art trencher contacts a work surface at a shallow angle when it is digging a shallow trench and often penetrates a work surface at a moderate angle when digging a deeper trench. If the trench is to be circular or curved, it becomes very difficult if not impossible to guide a shallow angled digging chain around a curved path while it is digging. A digging chain penetrating a working surface at a shallow or moderate angle will interfere with the walls of the trench if a curved section of trench is attempted. Moreover, in a prior art trencher, the digging chain is cantilevered away from the trencher carriage so that the center of the digging chain will swing through an arc as the carriage turns. Because it is not practical to turn a prior art trencher along a tightly curved path while it is digging a trench, intersecting trench sections must be dug to make a trench around an obstacle. Generally, significant amounts of material will accumulate where sections of the trench intersect. Material that accumulates at these intersections must be removed by hand digging. What is needed is a trencher that can easily dig circular or curved trenches and which can also smoothly transition from digging a straight trench to digging a curved trench when an obstacle is encountered.

SUMMARY OF THE INVENTION

Accordingly, it is an object of the present invention is to provide a trencher that can dig a curved trench. It is another object of the present invention to provide a trencher that can smoothly transition between excavating a straight section of trench and a curved section of trench. It is yet another object of the present invention to provide a trencher that has attachments for moving excavated material away from a trench as the trench is being excavated. It is still yet another object of the present invention to provide a trencher having adjustable earth moving blades that can be positioned for returning excavated material to a trench, for directing excavated material away from a trench or for scraping or smoothing a working surface.

These and other objects of the present invention are attained in an improved trencher which includes a carriage, a digging chain, a digging chain support frame and an upright boom structure. The carriage includes wheels for rolling across a working surface and a steering mechanism for turning the carriage. The digging chain support frame carries the digging chain and is mounted to the upright boom structure for upward and downward movement relative to the upright boom structure. The digging chain is carried by a pair of wheels that are rotatably mounted to the digging chain support frame and that are disposed so that the digging motion of the chain describes an upright path. The wheels include a sprocket wheel at the upper end of the digging chain support frame and an idler pulley wheel at the lower end of the digging chain support frame. A chain drive motor powers the movement of the sprocket wheel and the digging chain. A digging chain support frame actuator, operatively coupled to the digging chain support frame, raises and lowers the digging chain support frame relative to the upright boom structure and the trencher carriage. It is preferable to locate the upright boom structure and the digging chain support frame so that the path of the digging chain is close to the carriage when the digging chain is excavating a trench.

The trencher is operated by activating the chain drive motor and by also activating the digging chain support frame actuator to move the digging chain to penetrate a working surface. As the digging chain travels around the powered sprocket wheel and the idler pulley wheel, the carriage moves in a backward direction so that the digging chain follows the carriage as it excavates a trench. To dig a curved trench, the carriage is turned to follow a curved path. The upright orientation of the path of the digging chain facilitates the excavation of a curved trench. When following a curved path, the upright digging chain does not interfere with the walls of the trench by a degree that is sufficient to significantly impede its operation. The proximate location of the digging chain relative to the carriage also minimizes the degree by which the digging chain will swing against one of the walls of the trench if the trencher transitions from a straight path to a curved path. Accordingly, it is relatively easy to execute a smooth transition from excavating a straight trench to excavating a curved trench. If the operator gradually turns the carriage to a curved path, the digging chain will smoothly transition to following a curved path.

Preferably, an auger assembly is adjustably mounted to the digging chain support frame. Such an auger assembly includes transversely mounted augers that are powered by an auger sprocket wheel that engages the digging chain. As the digging chain is removing material from a trench, the rotating augers move excavated material away from the trench and the trencher. The location of the augers can be changed to correspond to a desired trench depth.

It is also preferable to mount a pair of earth moving blades on either side of the digging chain support frame. The earth moving blades are adjustably mounted on arms that can be interconnected to rotate in unison relative to the trencher carriage. The earth moving blades can be placed in various positions suitable for pushing material away from an excavated trench, pushing material into an excavated trench or when locked together to define a single blade, smoothing or scraping a working surface.

BRIEF DESCRIPTION OF THE DRAWINGS

The invention and its many attendant objects and advantages will become better understood upon reading the following description of the preferred embodiment in conjunction with the following drawings, wherein.

DETAILED DESCRIPTION OF PREFERRED EMBODIMENT

Figure 1:
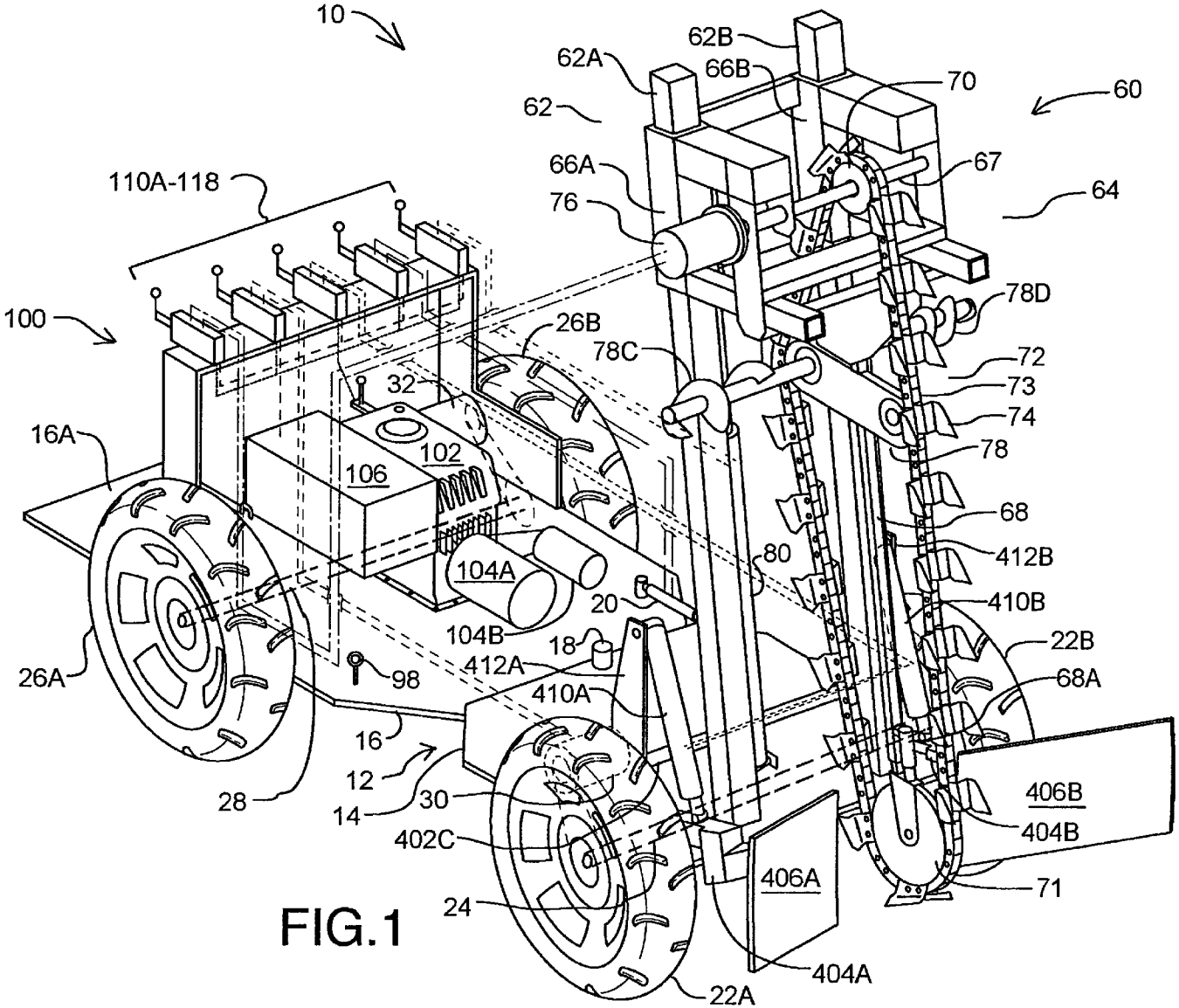
FIG. 1 is a perspective view of the trencher of the present invention.

Turning now to the drawings, wherein like reference numerals identify identical or corresponding elements, and more particularly to FIG. 1 thereof, a trencher 10 is shown. Trencher 10 generally includes a wheeled carriage 12, a boom 60 and a power system 100. Carriage 12 includes a forward portion 14 and a rear portion 16 which are articulated about a pivot joint 18. Wheeled carriage 12 is powered by a pair of hydraulic motors 30 and 32. Boom 60 includes a digging chain 72 that can be moved up and down past the end of carriage 12 to make contact with and to penetrate a working surface. Power system 100 includes an internal combustion engine 102 that drives hydraulic pumps 104A and 104B for supplying hydraulic power to the various hydraulic motors and cylinders that operate trencher 10. The configuration, arrangement and operation of the hydraulic system will be described in greater detail below.

Forward portion 14 and rear portion 16 of carriage 12 are articulated about carriage pivot joint 18 located at the center of carriage 12. A hydraulic steering cylinder 20 bridges between front portion 14 and rear portion 16 at one side of carriage pivot joint 16. As hydraulic steering cylinder 20 is extended, forward portion 14 and rear portion 16 pivot so that forward portion 14 moves relative to rear portion 16 in a clockwise direction as shown in FIG. 1. Similarly, as hydraulic steering cylinder 20 is retracted, forward portion 14 and rear portion 16 pivot so that forward portion 14 moves in a counter-clockwise direction relative to rear portion 16. Alternatively, two hydraulic cylinders such as hydraulic cylinder 20 arranged to move in an opposite corresponding manner on opposite sides of pivot joint 18 can be used to articulate carriage 12.

Carriage 12 rides on two forward wheels 22A and 22B mounted to forward axle 24 and two rear wheels 26A and 26B mounted to rear axle 28. Forward axle hydraulic drive motor 30 turns forward axle 24 while rear axle hydraulic drive motor 32 turns rear axle 28. Forward wheels 22A and 22B can freely turn on forward axle 24 or can be separately engaged with forward axle 24 to be powered by drive motor 30. In the same way, rear wheels 26A and 26B can freely turn on rear axle 28 or can be engaged with rear axle 28 to be powered by hydraulic drive motor 32.

Upright boom 60 includes an upright boom structure 62 and a digging chain support frame 64. Digging chain support frame 64 carries a digging chain 72 in an upright position. Digging chain 72 moves with digging chain support frame up and down relative to upright boom structure 62. Accordingly, digging chain 72 is lowered to a desired digging depth along an upright path rather than pivoted to a desired digging depth through a series of angled positions. This greatly reduces interference with the walls of a trench when digging chain 72 is excavating a trench along a curved path. This is especially true when digging chain 72 is excavating a relatively shallow trench. In fact, digging chain 72 can excavate a curved trench having an even smaller radius if the excavation is shallow where the opposite is true for a digging chain that is pivoted into a shallow digging position.

Figure 2:
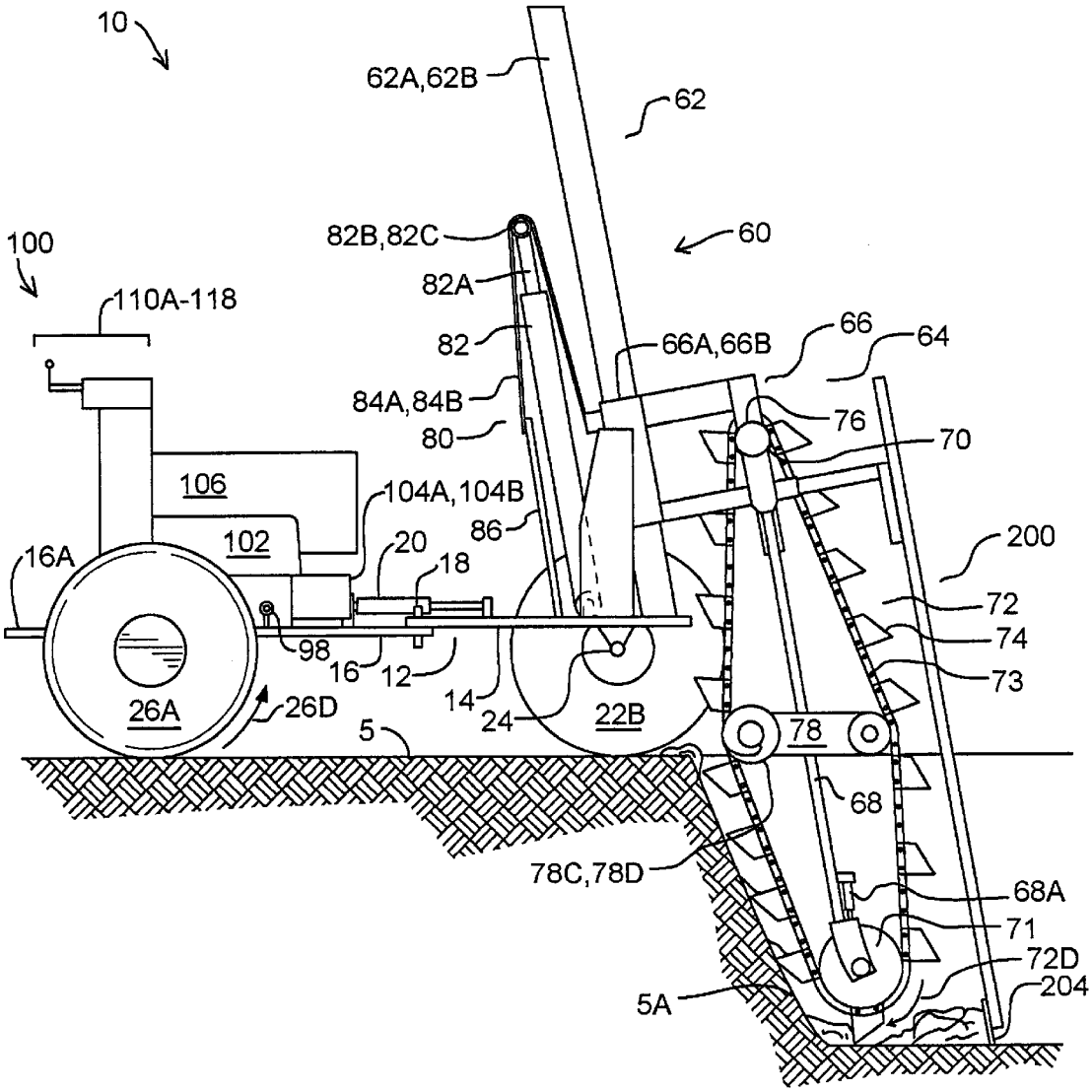
FIG. 2 is a right side view of the trencher of the present invention.

As can be seen in FIG. 1 and FIG. 2, upright boom structure 62 includes two upright columns 62A and 62B which are secured to forward portion 14 of carriage 12. Digging chain 72 is carried in an upright position by digging chain support frame 64. Digging chain support frame 64 carries digging chain 72 on two wheels which include a sprocket wheel 70 and an idler pulley wheel 71. Digging chain support frame 64 includes a truck portion 66 and a digging chain support member 68. Truck portion 66 slides up and down upon upright columns 62A and 62B on collars 66A and 66B. Truck portion 66 supports a transverse sprocket wheel shaft 67 that carries sprocket wheel 70. Sprocket wheel shaft 67 and sprocket wheel 70 are powered by a sprocket drive motor 76 mounted on one side of truck portion 66. Digging chain support member 68 is mounted to the bottom of truck portion 66 in an upright position. Digging chain support member 68 carries idler pulley wheel 71 at its lower end. The vertical position of idler pulley wheel 71 which can be adjusted to remove slack from digging chain 72 by adjusting changing the extension of a slack adjustment cylinder 68A. Digging chain 72 engages sprocket wheel 70 and idler pulley wheel 71, so that, when sprocket wheel 70 it is turned by sprocket wheel drive motor 76, digging chain 72 describes an upright path as it rotates in a clockwise direction as indicated by direction arrow 72D in FIG. 2.

Digging chain 72 is fashioned from links 73 that carry blades 74. Blades 74 are designed to separate and remove material from a trench as shown in FIG. 2. Sprocket wheel 70 is a conventional sprocket wheel that has teeth for engaging the openings between the links of digging chain 72. Idler pulley wheel 71 has a plain, flat shape. The links of digging chain 72 are shaped to present a continuous lengthwise channel for receiving the edge of idler pulley wheel 71. A plain, flat wheel is preferred for idler pulley wheel 71 over a sprocket wheel because the teeth of a sprocket wheel operating in the bottom of a trench will clog with dirt.

Preferably, it should be possible to remove blades 74 from digging chain links 73 and replace them with other blades having different widths for excavating trenches of correspondingly different widths. Preferably, the upright orientation of digging chain support member 68 should not deviate more than 20° from a vertical orientation and should most preferably be set at 10° from a vertical orientation. The path of digging chain 72 is also slightly angled relative to digging chain support member 68 by an auger drive sprocket 78A of an auger assembly 78 so that blades 74 of digging chain 72 move along a sloped path as they lift material from a trench. The upright orientation of digging chain 72 makes it possible to move digging chain 72 along a curved path without causing digging chain 72 to interfere with the walls of the trench to an extent that would be sufficient to impede the operation of digging chain 72.

Auger assembly 78 is adjustably mounted to digging chain support member 68 by a lockable collar. Auger drive sprocket wheel 78A of auger assembly 78 engages digging chain 72 so that it turns when digging chain 72 is moving. A pair of augers 78C and 78D mounted to auger drive sprocket wheel 78A are configured to transfer material removed from an excavated trench away from the trench and trencher 10. Auger assembly 78 can be adjusted and positioned on digging chain support member 68 at a location that corresponds to the desired trench depth. The lower edges of augers 78C and 78D should be positioned to correspond to the top of the working surface. Augers 78C and 78D are removable so that both augers may be removed or so that one auger or both augers may be employed.

As can be seen in FIG. 1 and FIG. 2, digging chain 72 can be moved up and down past one end of carriage 12 by a digging chain support frame actuator 80. Digging chain support frame actuator 80 includes a hydraulic cylinder 82 which has an extending and retracting piston rod 82A. Piston rod 82A carries a pair of sprockets 82B and 82C that engage a pair of chains 84A and 84B. Chains 84A and 84B are each fastened at one end to truck portion 66 of digging chain support frame 64 and at the other end to a support member 86 fixed to forward portion 14 of carriage 12. When piston rod 82A extends, sprockets 82B and 82C engaging chains 84A and 84B urge the chains to raise digging chain support frame 64. When piston rod 82A retracts, the opposite motion occurs and digging chain support frame 64 drops. The purpose of this arrangement is to permit digging chain support frame 64 to move twice the stroke distance of hydraulic cylinder 82. Those skilled in the art will readily appreciate that many other actuator arrangements could be considered for moving digging chain support frame 64. Such arrangements might include other hydraulic cylinder arrangements or other devices such as a powered winch.

Determining the best location for digging chain support frame 64 and digging chain 72 relative to carriage 12 involves a careful balancing of design trade-offs. For example, the path of digging chain 72 can be positioned to pass through an opening in the trencher carriage. If the path of digging chain is positioned to pass through an opening in the trencher carriage that is between the forward and rear wheels of the carriage, then, it is very easy for the carriage to transition from a straight path to a curved path while the digging chain is excavating a trench. This is because a centrally located digging chain will not swing relative to the carriage as the carriage articulates into a turn. Instead, as the carriage transitions to a curved path, the front and rear portions of the carriage will tend to turn about the centrally positioned digging chain. Accordingly, a trencher having an upright, centrally located digging chain is well adapted for digging trenches that transition between straight and curved sections. However, when the digging chain is located near the center of a trencher between the front and rear axles of the trencher, the digging chain will deposit excavated material under the trencher where it can not be easily removed and where it can build up in the path of at the trailing trencher wheels. It is possible to use augers or deflecting plates to push moderate amounts of excavated soil from under the trencher. However, it is difficult to remove large amounts of material while digging a relatively wide, deep trench. A centrally located digging chain has another disadvantage. With a centrally located digging chain, It is not possible to excavate a trench up to the edge of a structure as is often required during construction projects. So, while the present invention can be practiced with a centrally located digging chain, it is preferable to locate the digging chain where excavated material will not interfere with the operation of the trencher and so that the trencher can excavate a trench up to the edge of a structure.

Because of the above described disadvantages of locating digging chain 72 toward the center of a carriage, it is preferable to locate the digging chain support frame, as shown in FIG. 1 and FIG. 2 so that digging chain 72 can operate slightly forward of forward axle 24 as trencher 10 moves in a backward direction as shown in FIG. 2. Digging chain support member 68, as shown in FIG. 1 and FIG. 2, is located forward of axle 24 and as close as possible to forward axle 24 and forward wheels 22A and 22B. As noted above, digging chain 72 can excavate a curved trench because it is upright and because it moves up and down relative to trencher 10 along an upright path. However, with the configuration shown in FIG. 1 and FIG. 2, when digging chain 72 is excavating a straight trench and carriage 12 is then articulated to begin moving along a curved path, digging chain 72 will swing slightly against a wall of the trench. Accordingly, it is preferable to locate digging chain 72 as close as possible to the center of carriage 12 to minimize this swinging motion while also locating digging chain 72 far enough away from forward wheels 22A and 22B to allow excavated material to be rejected away from an excavated trench. If the operator gradually transitions trencher 10 from a straight path to a curved path, the effects of the above described swinging movement of digging chain 72 diminish so that trencher 10 can be smoothly transitioned from a straight path to a curved path.

As can be seen in FIG. 2, a platform 16A is provided at the back of rear portion 16 of carriage 12. Platform 16A accommodates an operator who operates controls 110A, 110–116. As shown in FIG. 2, trencher 10, when it is digging, moves in a backward direction with rear wheels 26A and 26B leading forward wheels 22A and 22B. When it is digging, the wheels of trencher 10 turn in the direction indicated by direction arrow 26D in FIG. 2. As trencher 10 moves in a backward direction, digging chain 72, as seen in FIG. 2, rotates in a clockwise direction as indicated by direction arrow 72D in FIG. 2. Digging chain 72 scoops up material from under working surface 5 to form trench 5A and deposits that material in front of carriage 12. If a relatively deep trench is being dug, augers 78C and 78D can be located to be even with surface 5 and used to push excavated material away from trencher 10 and the excavated trench.

Figure 3:
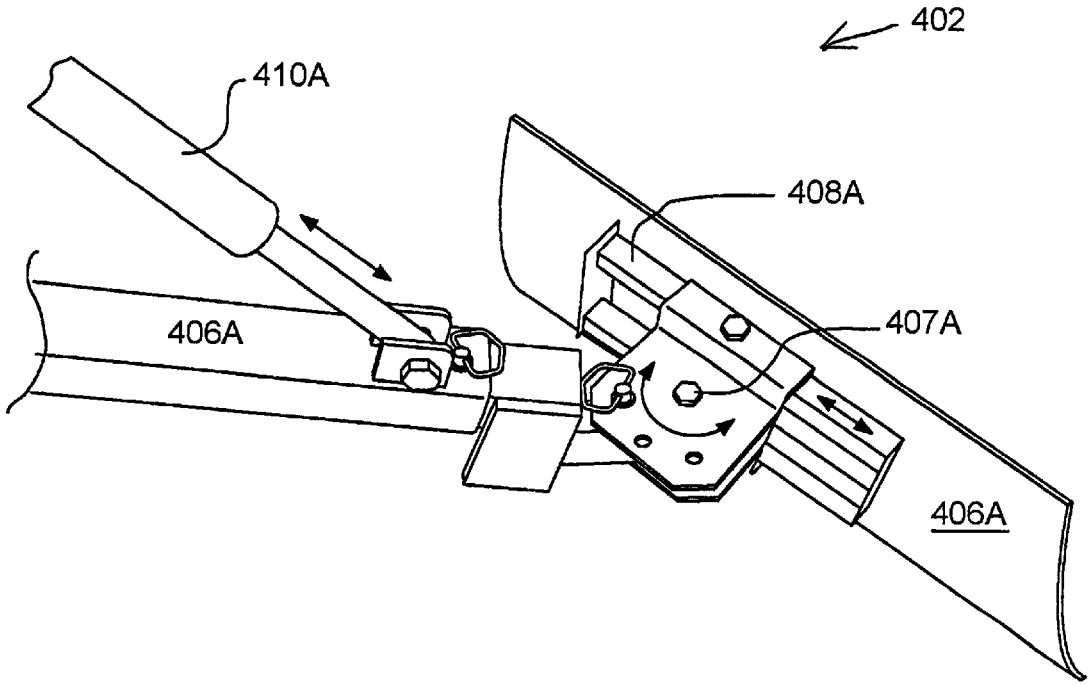
FIG. 3 is a perspective view showing one of two an earth moving blade assemblies.
Figure 4:
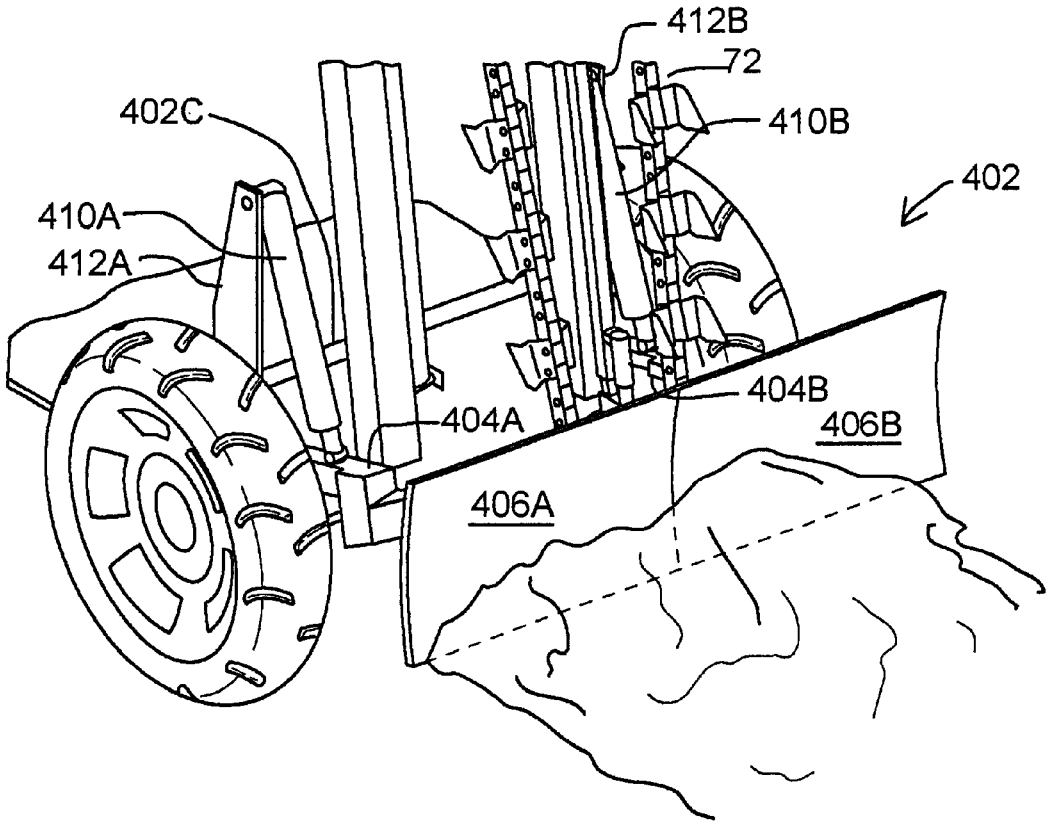
FIG. 4 is a perspective view showing the earth moving blade assemblies joined together to move earth.

FIG. 3 and FIG. 4 illustrate an optional split earth moving blade assembly 402. FIG. 3 only illustrates one side of this arrangement. The other side of the earth moving blade assembly is symmetrically identical to the one shown in FIG. 3. Earth moving blade assembly 402 is mounted to forward portion 14 of carriage 12 on a pair of arms 404A and 404B that are actuated by hydraulic cylinders 410A and 410B. Hydraulic cylinders 410A and 410B connect between a pair of upright supports 412A and 412B and arms 404A and 404B. When hydraulic cylinders 410A and 410B extend or retract, arms 404A and 404B rotate in unison about a shaft 402C. Shaft 402C is pivotably mounted to forward portion 14 of carriage 12.

As shown in FIG. 3, mounted to the ends of arms 404A and 404B are two earth moving blades 406A and 406B. Blades 406A and 406B are both pivotably and slidably mounted at the ends of their respective arms 404A and 404B. They can be adjustably rotated with respect to the end of each arm about pivot joints 407A and 407B and they can be adjustably slid in a transverse direction about slide mounts 408A and 408B with respect to the end of each arm. Because blades 406A and 406B are adjustably mounted to arms 404A and 404B, they can be positioned to push material away from a trench or back into a trench. Earth moving blades 406A and 406B can be also be joined together to present a single, flat blade for scraping or smoothing a surface as shown in FIG. 4.

As is shown in FIG. 2, a plate assembly 200 is mounted to the front of truck portion 66 of digging chain support frame 64. The purpose of plate assembly 200 is to reduce the amount of loose material left in the bottom of an excavated trench by pushing such loose material forward so that it can be captured and removed by digging chain 72. Plate assembly 200 moves with truck portion 66 and digging chain 72. Plate assembly 200 includes an adjustable arm 202 that carries a plate 204. When in use, adjustable arm 202 is positioned so plate 204 is at the same level as the lower end of digging chain 72. As digging chain excavates a trench, loose material will accumulate in front of plate 204 until the loose material is removed from the trench by digging chain 72.

The configuration of power system 100 is one of many possible power systems. Mechanical linkages might be more efficient than a hydraulic system but more cumbersome. An electrical system including a generator that powers various electric motors might be less cumbersome but more expensive and less energy efficient. Hydraulic power system 100 is intended to present a simple and practical system.

Figure 5:
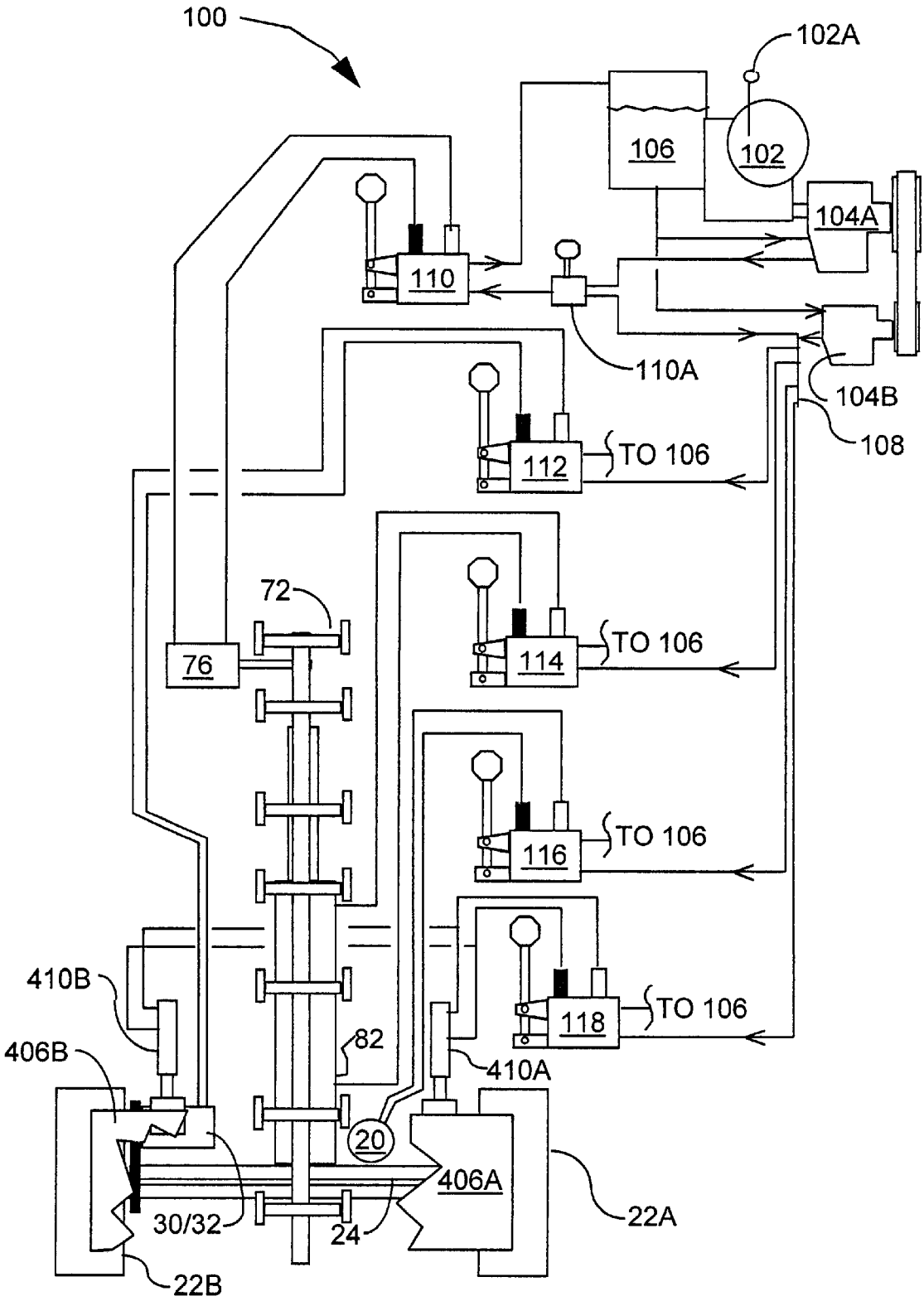
FIG. 5 is a schematic of the hydraulic system of the trencher of the present invention.

Power system 100 is schematically illustrated in FIG. 5. Power system 100 is carried primarily by rear portion 16 of carriage 12. Power system 100 includes an internal combustion engine 102 that drives primary and secondary hydraulic pumps 104A and 104B. Primary and secondary hydraulic pumps 104A and 104B receive hydraulic fluid from a hydraulic fluid reservoir 106 and supply pressurized hydraulic fluid to control valves 110, 112, 114, 116 and 118 which supply hydraulic fluid to the various hydraulic cylinders and hydraulic motors that operate trencher 10.

Switching valve 110A switches power system 100 between a digging mode and a non-digging mode. When power system 100 is in the digging mode, switching valve 110A directs the output of primary hydraulic pump 104A which converts most of the power output of engine 102 to control valve 110. Control valve 110 controls the flow of hydraulic fluid to and from sprocket wheel drive motor 76 which powers digging chain 72. The operation of digging chain 72 is the most energy intensive operation performed by trencher 10. Secondary pump 104B converts a smaller portion of the power output of engine 102 into hydraulic power. When switching valve 110A is in the digging mode position, during the operation of digging chain 72, secondary pump 104B supplies hydraulic fluid via control valves 112–118 to power functions other than the operation of digging chain 72.

When digging chain 72 is inactive, switching valve 110A can be positioned to switch power system 100 to the non-digging mode. When in the non-digging mode position, switching valve 110A diverts the output of primary hydraulic pump 104A away from control valve 110 to a flow splitter 108. Flow splitter 108 also receives fluid from secondary hydraulic pump 104B and, as noted above, provides hydraulic fluid to control valves 112–118 which control the various functions of trencher 10 other than the operation of digging chain 72. When power system 100 is in the non-digging mode, these other functions of trencher 10 can operate at higher speeds and with more power.

FIG. 5 provides a schematic diagram of power system 100. As can be seen in FIG. 5, power system 100 includes switching valve 110A and control valves 110 through 118. Switching valve 110A directs flow from primary pump 104A to first control valve 110 when in the digging mode position or to flow splitter 108 that feeds control valves 112–118 when in the non-digging mode position. First control valve 110 controls the operation of sprocket wheel drive motor 76 which drives digging chain 72. As is the case with all of the control valves, when first control valve 110 is in the neutral position, the hydraulic fluid received by control valve 110 is returned to a hydraulic fluid reservoir 106. Second control valve 112 controls axle drive motors 30 and 32. It behaves much like a throttle and is therefore biased in a neutral position. Third control valve 114 controls hydraulic cylinder 82 which is used to move digging chain support frame 64 and digging chain 72 up and down. Fourth control valve 116 controls the flow of fluid to and from steering cylinder 20. The extension of steering cylinder 20 causes forward portion 14 and rear portion 16 to pivot so that rear portion 16 moves in a counter-clockwise direction relative to forward portion 14 when viewed from the perspective of FIG. 1. The contraction of steering cylinder 20 causes an opposite movement. Fifth control valve 118 controls hydraulic cylinders 410A and 410B that move earth moving blades 406A and 406B up and down. Third, fourth and fifth control valves 114, 116 and 118 control functions that should respond to positive control inputs from an operator and therefore should be biased in a neutral position to return fluid to reservoir 106 when not activated.

When switching valve 110A is positioned to activate the non-digging mode, switching valve 110A cuts off the flow of fluid from primary hydraulic pump 104A to first control valve 110 which serves sprocket wheel drive motor 76 and diverts that flow via flow splitter 108 to second, third, fourth and fifth control valves 112, 114, 116 and 118. As shown in FIG. 5, control valves 112, 114, 116 and 118 respectively control axle drive motors 30 and 32, hydraulic cylinder 82 of digging chain support frame actuator 80, steering cylinder 20 and hydraulic cylinders 410A and 410B that actuate earth moving blade assembly 402. When switching valve 110A is positioned to activate the non-digging mode, the functions controlled by control valves 112, 114, 116 and 118, such as for example (and most importantly) the operation of forward axle hydraulic drive motor 30 and rear axle hydraulic drive motor 32, can be conducted with more power and at a much greater speeds. When power system 100 is in the non-digging mode, trencher 10 can travel at a higher rate of speed, turn rapidly and quickly perform earth moving operations.

To dig a circular trench, a rope or a chain may be connected from a center point at a construction site to a guide bracket 98 shown in FIG. 1 and FIG. 2. An operator observing the degree of slack in the chain or rope may adjust fourth valve 116 to cause trencher 10 to follow a desired curved path. Guide bracket 98 could be mounted to a tension sensor means that would automatically adjust the flow of hydraulic fluid to steering cylinder 20 in response to changes in tension so that trencher 10 might automatically maintain a constant distance from a center point as it describes a circular path about the center point.

Trencher 10 is operated to dig a curved trench such as trench 5A shown in side view in FIG. 2 in a working surface such as working surface 5 shown in FIG. 2 by executing the following steps: (1) Auger assembly 78 is positioned upon digging chain support member 68 to corresponds to the desired depth of the trench. (2) Switching valve 110A is positioned in the digging mode position so that fluid from primary pump 104A flows to control valve 110. (3) Control valve 110 is positioned so that hydraulic fluid is directed from pump 104A to sprocket wheel drive motor 76. This action causes digging chain 72 to rotate upon digging chain support member 68 in a clockwise direction as indicated by a direction arrow 72D in FIG. 2. (4) Digging chain support member 68 and digging chain 72 are lowered past carriage 12 by moving third control valve 114 into a position so that fluid is directed from secondary pump 104B to digging chain support frame actuator 80 to cause cylinder 82 to contract. This action causes digging chain 72 to dig into a working surface 5. The operator can select the depth of a trench such as trench 5A shown in FIG. 2 by releasing neutrally biased third valve 114 when digging chain 72 has descended to the desired depth. When neutrally biased control valve 114 is released, digging chain 72 will remain in the selected position. (5) Power is provided to forward axle hydraulic drive motor 30 and rear axle hydraulic drive motor 32 by moving second control valve 112 into a position that causes wheels 22A and 26B to turn in a counter-clockwise direction as indicated by direction arrow 26D in FIG. 2. Preferably, at least one wheel on each axle is engaged with its axle and it is also preferred that the selected engaged wheels are on the same side of carriage 12. Trencher 10 will move in a backward direction as an operator standing on platform 16A shown in FIG. 2 leads trencher 10. (6) The turning radius of trencher 10 is adjusted by providing fluid to one side of steering cylinder 20 by manipulating fourth control valve 116 until the curved path of trencher 10 follows the desired path. As noted above the operator can guide trencher 10 with great precision along a desired circular path by observing the slack in a flexible line such as a chain or a rope secured at one end to a member at the center of the circular path and at the other end to guide bracket 200. When the trench is finished, third control valve 114 can be manipulated to raise trencher frame 70 to pull digging chain 72 out of the finished trench.

An operator can also transition trencher 10 from excavating a straight trench section to excavating a curved trench section. This might be done, for example, to dig curved sections around an obstacle. Preferably, an operator should gradually initiate such a transition by slowly moving control valve 116 while trencher 10 is moving. A sudden, large movement of steering cylinder 20 will articulate carriage 12 and swing digging chain 72 into a wall of the excavated trench. However, since digging chain 72 is upright and located close to carriage 12, a gradual transition to a curved path as trencher 10 is moving can be easily accomplished by gradually adjusting the position of steering cylinder 20 as trencher 10 moves. Such a gradual transition allows digging chain 72 to smoothly transition from a straight path to a curved path as it removes material.

The above described operations may be also be enhanced with other operations if trencher 10 also has an optional split earth moving blade assembly 402 and pivoting frame 404 shown in FIG. 3 and FIG. 4. With that added equipment a trench can be excavated as described above for the purpose of receiving for example a water or electric line and then filled using split blade assembly 402. When in a lowered, split configuration, split blade assembly 402 can be used to push excavated soil back into an excavated trench as trencher 10 moves in a direction that is reversed from that described above. When in a lowered, joined condition, split blade assembly 402 can be used to smooth excavated soil. When trencher 10 is executing earth moving tasks, digging chain 72 is retracted and inactive and switch valve 110A is turned in the non-digging mode position so that hydraulic fluid from primary pump 104A is directed to control valves 112 through 118. This allows for the rapid and energetic operation of hydraulic motors 30 and 32 which power carriage 12, steering cylinder 20 which turns carriage 12 and hydraulic cylinders 410A and 410B which actuate earth moving blade assembly 404.

Trencher 10, as described above, meets the objects noted above by providing a trencher that can easily excavate curved trenches of varying depths. The trencher of the present invention can be operated to transition from excavating a straight section of trench to a curved section of trench. The problems associated with excavating and back filling curved trenches have been eliminated permitting those practicing this invention to create shallow and moderately deep trenches having various circular or curved shapes. The above described trencher also has adjustable augers for transferring excavated material away from a trench. The trencher described above also includes earth moving blades which can be positioned to direct material away from or toward a trench or which can be positioned together for earth smoothing operations. The trencher described above includes a versatile hydraulic power system that can operate in a digging mode where most of the hydraulic power is directed toward the digging chain and a non-digging mode where the hydraulic power is distributed to functions that do not involve the operation of the digging chain. These features complete a trencher that is extremely versatile and highly adapted for a broad range of excavating and earth moving processes that occur during construction operations.

The skilled reader, in view of this specification may envision numerous modifications and variations of the above disclosed preferred embodiment. Accordingly, the reader should understand that these modifications and variations, and the equivalence thereof, are within the spirit and scope of this invention as defined in the following claims, wherein I claim:

1. A trencher comprising:

(a) a carriage for movement over a working surface, the carriage having a steering mechanism for turning the carriage to follow a curved path, (b) an upright boom structure mounted to the carriage, (c) a digging chain support frame mounted to the boom structure for upward and downward translation relative to the boom structure along a substantially upright path, (d) an endless digging chain engageable with wheels rotatably mounted to the digging chain support frame and disposed so that the digging chain describes an upright path, (e) a chain drive motor for causing movement of the wheels and the digging chain, (f) a digging chain support frame actuator operatively coupled to the digging chain support frame for raising and lowering the digging chain support frame relative to the upright boom structure along a substantially upright path, and (g) an auger assembly adjustably mounted to the digging chain support frame for placement in a position corresponding to a desired trench depth, the auger assembly including an auger drive sprocket wheel for engaging the digging chain and at least two augers each mounted to the auger drive sprocket wheel on opposite sides thereof, the augers for transferring material away from the digging chain as the digging chain excavates material from a trench, whereby the upright digging chain may be lowered into the working surface by activation of the digging chain support frame actuator to excavate a trench as the augers of the auger assembly push excavated soil away from the trench and whereby the upright digging chain may also dig a curved trench as the trencher follows a curved path while the digging chain does not sufficiently interfere with the walls of the trench to impede the operation of the trencher.

2. The trencher of claim 1, wherein:

the carriage is a wheeled carriage that includes a forward portion and a rear portion pivotably connected at a joint and the steering mechanism includes an actuator that causes relative rotating movement between the forward portion of the carriage and the rear portion of the carriage about the joint.

3. The trencher of claim 1 wherein:

the upright boom structure is mounted to the carriage and the digging chain support frame is mounted to the upright boom structure so that the digging chain support frame can be lowered along a path that is sufficiently close to the carriage to permit short radius turning of the carriage as the digging chain excavates a trench.

4. The trencher of claim 1 wherein:

the upright boom structure is mounted to the carriage and the digging chain support frame is mounted to the upright boom structure so that when the lower end of the digging chain is in a lowered position below the working surface while excavating a trench, the digging chain describes a path that is sufficiently upright to permit a short radius turning of the carriage as the digging chain excavates the trench.

5. The trencher of claim 1 wherein:

the upright boom structure is mounted to the carriage and the digging chain support frame is mounted to the upright boom structure so that when the digging chain is in a lowered position below the working surface while excavating a trench, the digging chain is sufficiently close to the center of the carriage and the digging chain describes a path that is sufficiently upright to permit a short radius turning of the carriage as the digging chain excavates the trench.

6. A trencher comprising:

(a) a wheeled carriage for movement over a working surface, the carriage having a steering mechanism for turning the carriage to follow a curved path, (b) an upright boom structure mounted to the carriage, (c) a digging chain support frame mounted to the boom structure for upward and downward translation relative to the boom structure along a substantially upright path, (d) a digging chain engageable with wheels rotatably mounted to the digging chain support frame, the wheels disposed so that the digging chain describes an upright path, the wheels including a sprocket wheel that engages the digging chain, (e) an auger assembly adjustably mounted to the digging chain support frame for placement in a position corresponding to a desired trench depth, the auger assembly including an auger drive sprocket wheel for engaging the digging chain and at least two augers each mounted to the auger drive sprocket wheel on opposite sides thereof, the augers for transferring material away from the digging chain as the digging chain excavates material from a trench, (f) a digging chain drive motor that powers the sprocket wheel for movement of the digging chain and the augers of the auger assembly, and (g) a digging chain support frame actuator operatively coupled to the digging chain support frame for raising and lowering the digging chain support frame relative to the upright boom structure, whereby the upright digging chain may be lowered into the working surface by activation of the digging chain support frame actuator to excavate a trench as the augers of the auger assembly push excavated soil away from the trench and whereby the upright digging chain may also dig a curved trench as the trencher follows a curved path while the digging chain does not sufficiently interfere with the walls of the trench to impede the operation of the trencher.

7. The trencher of claim 6, wherein:

the carriage includes a forward portion and a rear portion rotatably connected at a joint and the steering mechanism includes an actuator that causes relative rotating movement between the forward portion of the carriage and the rear portion of the carriage about the joint.

8. The trencher of claims 6, wherein:

the upright boom structure is mounted to the carriage and the digging chain support frame is mounted to the upright boom structure so that the digging chain support frame can be lowered along a path that is sufficiently close to the carriage to permit a short radius turning of the carriage as the digging chain excavates a trench.

9. The trencher of claim 6 wherein:

the upright boom structure is mounted to the carriage and the digging chain support frame is mounted to the upright boom structure so that when the digging chain is in a lowered position so that the lower end of the digging chain is below the working surface and the digging chain is excavating a trench, the digging chain follows a path that is sufficiently vertical to permit a short radius turning of the carriage as the digging chain excavates the trench.

10. The trencher of claim 6 wherein:

the upright boom structure is mounted to the carriage and the digging chain support frame is mounted to the upright boom structure so that when the digging chain is in a lowered position so that the lower end of the digging chain is below the working surface and the digging chain is excavating a trench, the digging chain is sufficiently close to the carriage and follows a path that is sufficiently upright to permit a short radius turning of the carriage as the digging chain excavates the trench.

11. The trencher of claim 6 further comprising:

at least one earth moving blade adjustably mounted to the carriage for moving excavated material away from or toward an excavated trench.

* * * * *